US005842780A

United States Patent [19]

Causby et al.

[11] Patent Number: 5,842,780

[45] Date of Patent: Dec. 1, 1998

[54] PULL CHAIN LAMPHOLDERS FOR MOUNTING UPON OUTLET BOXES

[75] Inventors: Leonard S. Causby, Morganton; Donald C. Plaster, Jr.; Rick L. Wyke, both of Valdese, all of N.C.

[73] Assignee: Leviton Manufacturing Co., Inc., Little Neck, N.Y.

[21] Appl. No.: 824,898

[22] Filed: Mar. 26, 1997

[51] Int. Cl.[6] ..... F21V 23/04

[52] U.S. Cl. ..... 362/394; 362/457; 362/458; 439/660; 439/672; 439/676; 200/51.15; 200/51.16

[58] Field of Search ..... 362/394, 457, 362/458; 439/660, 672, 667, 666; 200/51.15, 51.16, 294, 296

[56] References Cited

U.S. PATENT DOCUMENTS

| | | | |
|---|---|---|---|
| 1,214,353 | 1/1917 | Morey | 200/51.15 |
| 1,895,050 | 1/1933 | Russell | 200/51.15 |
| 2,215,715 | 9/1940 | Peck | 200/51.15 |
| 2,217,395 | 10/1940 | Wertzheiser | 439/667 |
| 2,340,062 | 1/1944 | Kulka | 439/667 |
| 2,567,961 | 9/1951 | O'Brien et al. | 200/51.15 |
| 2,684,470 | 7/1954 | Cataldo | 200/51.15 |
| 2,948,786 | 8/1960 | Scott | 200/51.15 |
| 3,018,342 | 1/1962 | Bullis | 200/51.16 |
| 3,827,003 | 7/1974 | Sullivan | 439/667 |

*Primary Examiner*—Ira S. Lazarus
*Assistant Examiner*—David B. Lee
*Attorney, Agent, or Firm*—Paul J. Sutton

[57] ABSTRACT

A pull chain outlet box lampholder which is assembled at the factory and does not require the mating of parts of dissimilar material in the field. A body member has a recess in its rear face to accept a switch assembly. A bore in the neck of the body member receives a threaded screwshell. Fasteners extend from the screwshell to the switch assembly to assemble these parts and to clamp an annular ring in the bore between them whereby the switch assembly and the screwshell are held in assembly to each other and to the body member.

10 Claims, 7 Drawing Sheets

PULL CHAIN LAMPHOLDERS FOR MOUNTING UPON OUTLET BOXES

BACKGROUND OF THE INVENTION

1. Field of the Invention

The invention relates to lampholders and more particularly to pull chain operated lampholders to be mounted upon outlet boxes mounted in a ceiling, walls, etc.

2. Description of the Prior Art

The typical pull chain operated lampholders of the known prior art include a body member with a central cavity and a central bore extending through the body member. A switch and a threaded screwshell are joined together and inserted through the body member rear surface such that the switch rests in the central cavity and the threaded screwshell extends through the central bore with a portion extending beyond a neck of reduced diameter. An internally threaded cap is screwed over the exposed end portion of the threaded screwshell to anchor the switch and screwshell in position and insulate the exposed end portion of the threaded screwshell.

Since the threaded screwshell is metal and the cap is of an insulating material such as porcelain, the external screw thread of the threaded screwshell and the internal threads of the cap do not closely match making assembly in the field difficult. Also, if the adjoining surfaces of the cap and neck of the body member which defines the bore are not flat and regular the cap may not sit properly on the threaded screwshell making assembly insecure.

SUMMARY OF THE INVENTION

The lampholder of the instant invention overcomes the difficulties noted above with respect to prior art devices. A body member is formed with a recess or cavity in its rear surface to accept a switch assembly and a neck extending from its front surface with a central bore therethrough in which is placed a threaded screwshell. An annular ring is placed in the central bore adjacent its intersection with the recess. The switch assembly is placed in the recess and against one surface of the annular ring. A threaded screwshell is introduced via the central bore to engage the opposite surface of the annular ring. Fasteners join the threaded screwshell to the switch assembly trapping the annular ring between them. In that the switch assembly is larger than the central bore it can not be removed via the central bore. Tabs extending outwardly from the threaded screwshell engage recesses in the face of the annular ring to prevent the threaded screwshell being removed from the body member via the rear recess. It is an object of this invention to provide a novel lampholder which can be mounted upon an outlet box.

It is an object of the instant invention to provide a novel lampholder whose component assemblies can be assembled in the factory.

It is yet another object of the instant invention to provide a novel lampholder whose component assemblies do not have to be assembled in the field.

Other objects and features of the invention will be pointed out in the following description and claims and illustrated in the accompanying drawings, which disclose, by way of example, the principles of the invention, and the best mode which is presently contemplated for carrying it out.

BRIEF DESCRIPTION OF THE DRAWINGS

In the drawings in which similar elements are given similar reference characters.

DESCRIPTION OF THE PREFERRED EMBODIMENT

Figure 1:
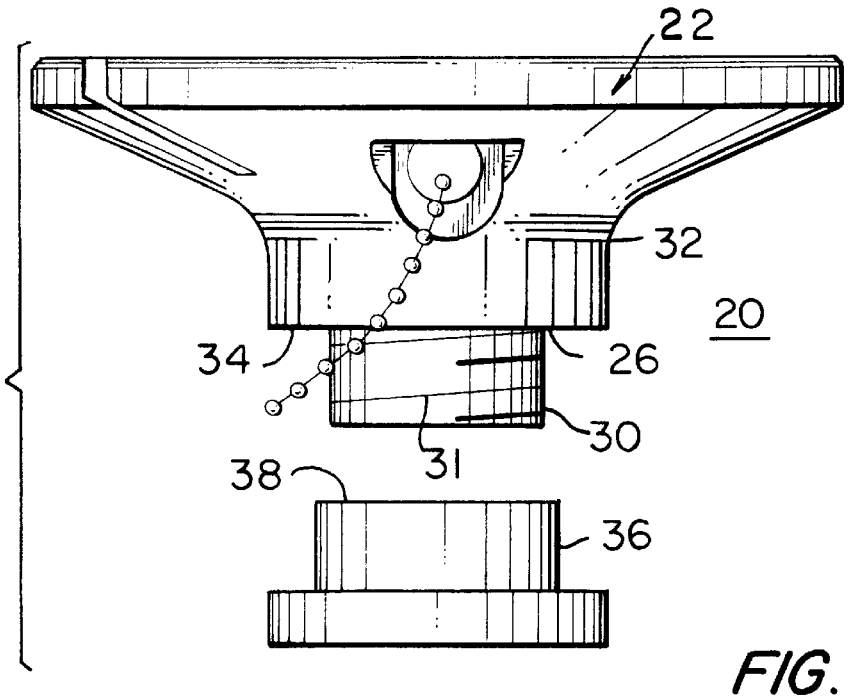
FIG. 1 PRIOR ART
FIG. 1 is an exploded side elevational view of a lampholder for installation upon an outlet box according to the prior art.
Figure 2:
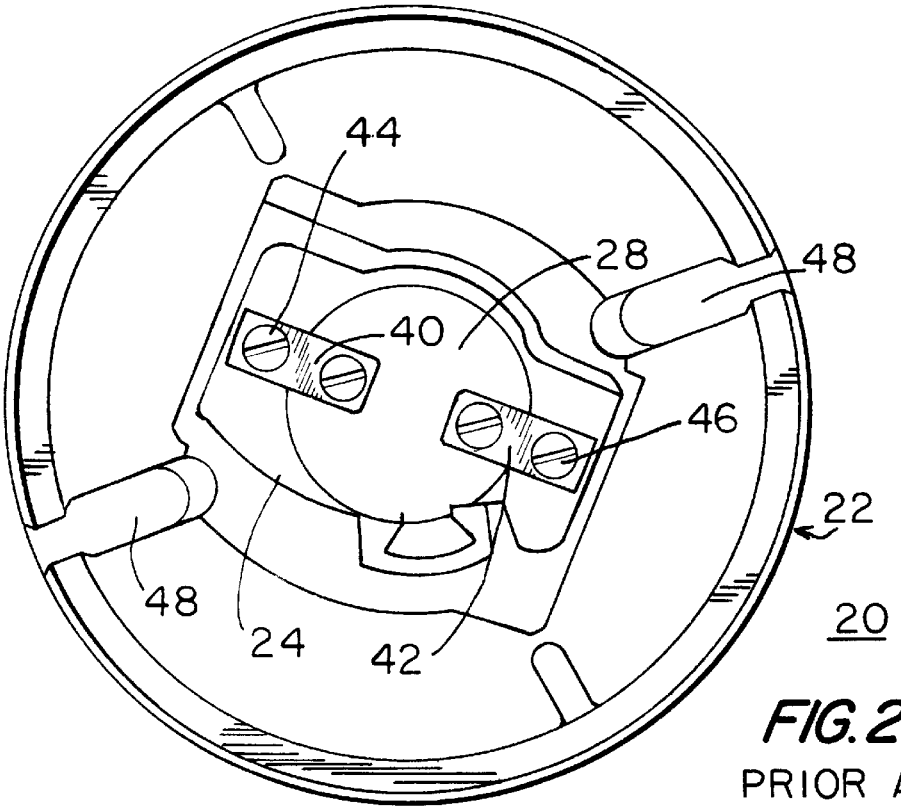
FIG. 2 PRIOR ART
FIG. 2 is a rear plan view of the device of FIG. 1.

Turning now to FIGS. 1 and 2 there is shown a lampholder 20 according to the prior art. A body member 22 of an insulating material such as porcelain has a recess or cavity 24 which communicates with a central bore 26. A pull chain switch assembly 28 is positioned in the recess 24 with the attached threaded screwshell 30 extending through bore 26 and beyond the end 34 of neck 32. A cap 36, having a central bore and the walls of the central bore threaded is screwed onto the external threads 31 of the threaded screwshell 30 to hold the switch assembly body member 28 and screwshell 30 in assembly. In a properly matched unit the top surface 38 of cap 36 will engage end 34 of neck 32 and there will be no gaps with the screwshell 30 exposed and the switch assembly 28 will be fully seated in the recess 24. The electrical conductors in the outlet box will be connected to switch assembly 28 by means of contact strips 40, 42 each of which contains a terminal screw 44, 46, respectively.

In the usual case, the cap 36 is removed and the body member 22 is separated from the switch assembly 28 and threaded screwshell 30. Separating the body member 22 from the switch assembly 28 and screwshell 30, gives the installer a much lighter element to support. The electrical conductors are then attached, one to terminal screw 44 and the other to terminal screw 46. The threaded screwshell 30 with switch assembly 28 attached is now inserted with a portion extending beyond end 34 of neck 32 and the cap 36 is screwed on to the exposed portion of the screwshell 30 which extends beyond end 34 of neck 32. The completed lampholder 20 can now be mounted to an outlet box (not shown) by passing suitable fasteners (not shown) through slots 48 and into the threaded apertures in the ears of the outlet box (not shown). Because the industry uses different sized outlet boxes, it is necessary to have lampholders which will fit each of the different sized outlet boxes. The installer must hold the assembled lampholder 20 in place while he installs the fasteners through the slots 48 and into the threaded apertures in the ears of the outlet box.

Figure 3:
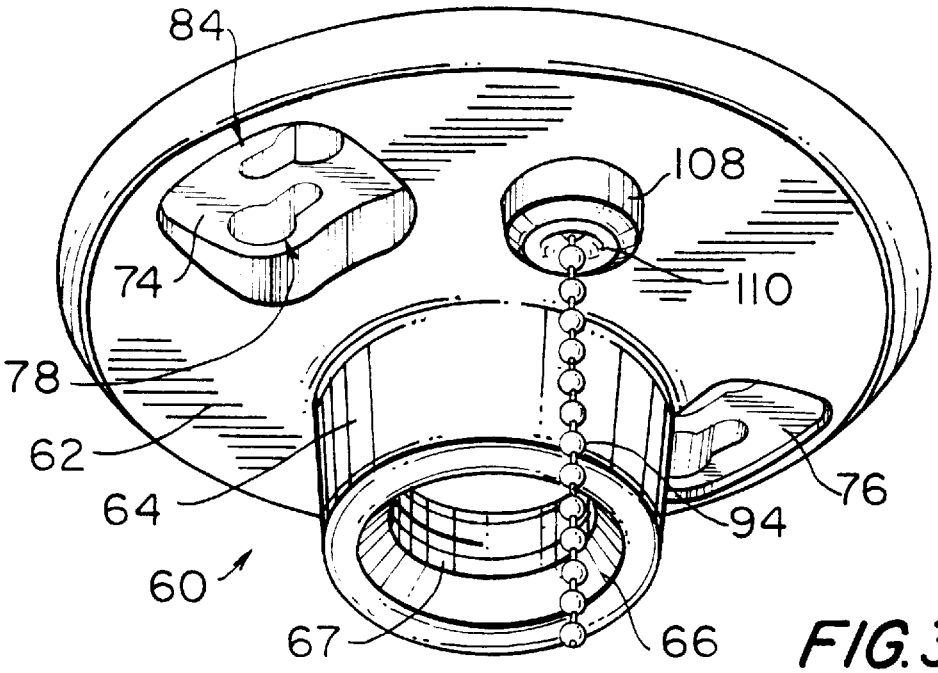
FIG. 3 is a front, lower right perspective view of a lampholder constructed in accordance with the concepts of the invention.
Figure 4:
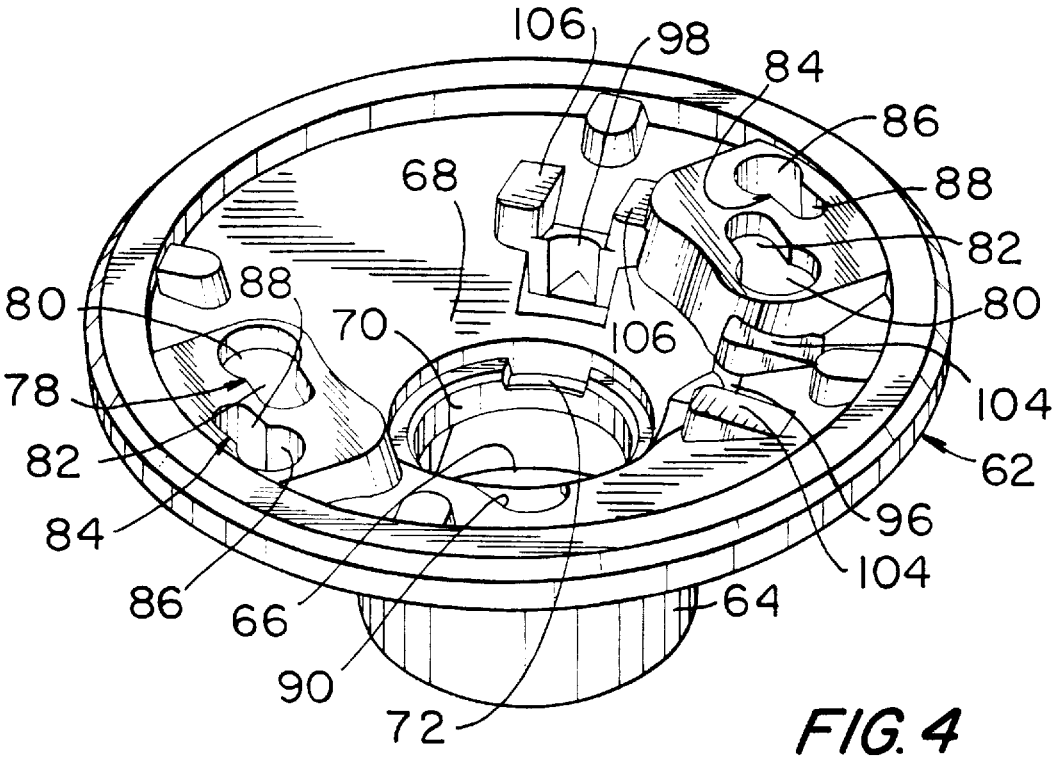
FIG. 4 is a top, upper right perspective view of the lampholder of FIG. 3.
Figure 5:
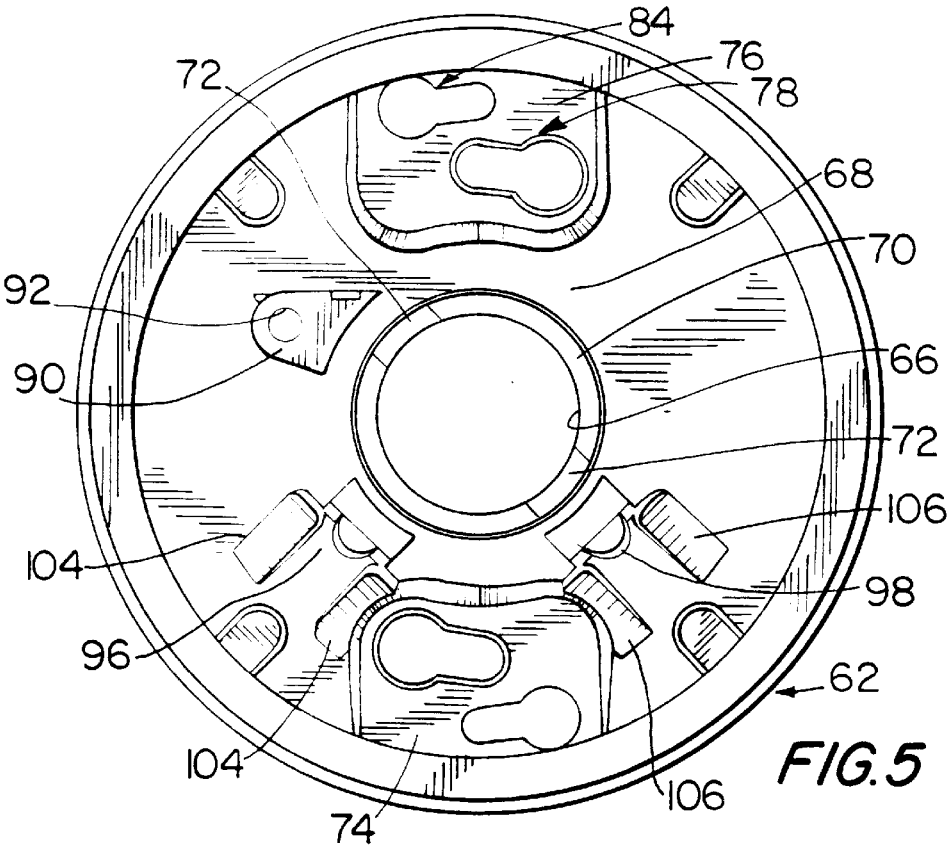
FIG. 5 is a top plan view of the body member of the lampholder of FIG. 3.
Figure 12:
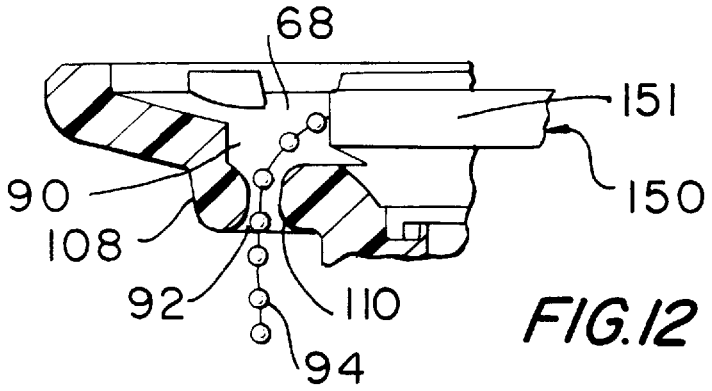
FIG. 12 is a fragmentary side elevational view, partly in section, of the body member showing the pull chain exit aperture and a portion of the switch assembly.
Figure 13:
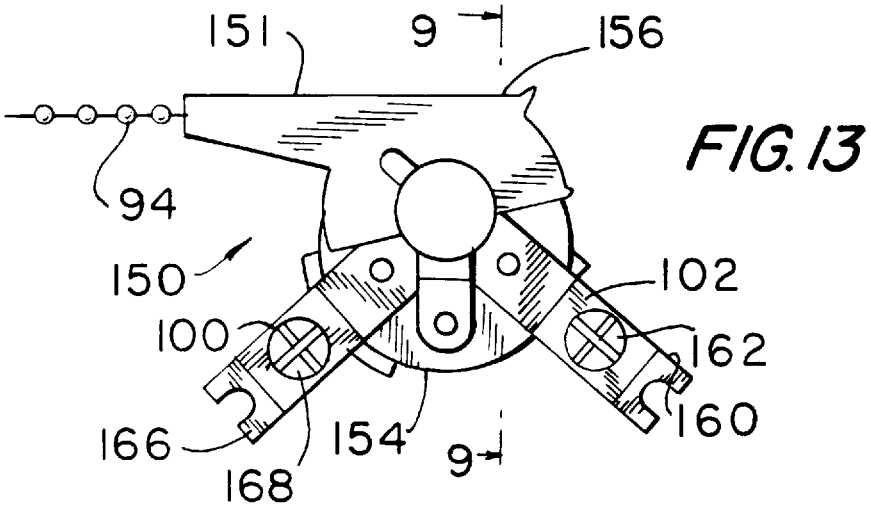
FIG. 13 is a top plan view of the switch assembly.
Figure 14:
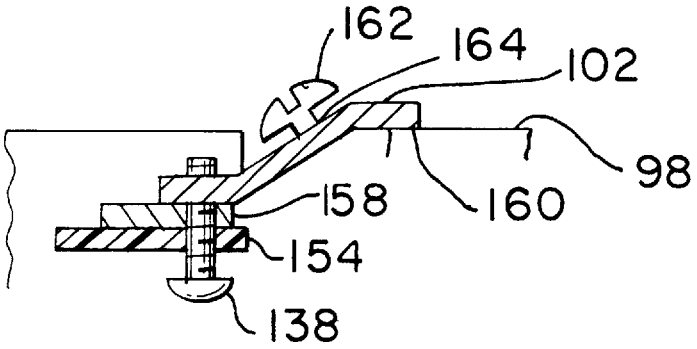
FIG. 14 is a fragmentary, side elevational view, partly in section, of the assembly of the conductor terminal strips with the switch assembly.
Figure 15:
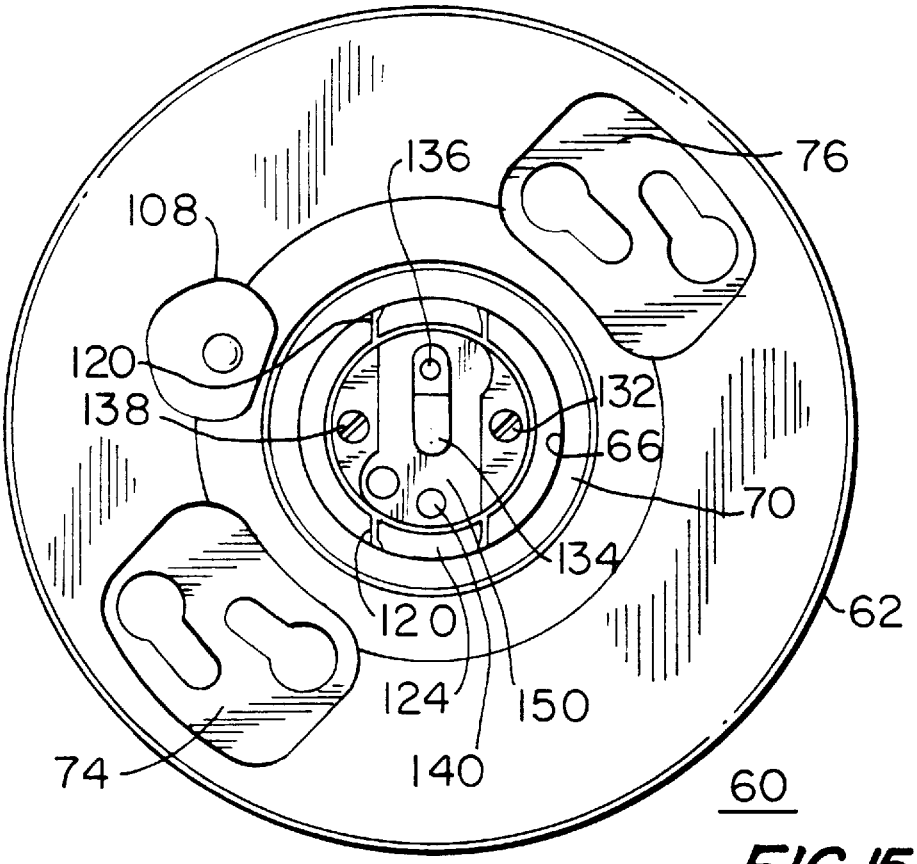
FIG. 15 is a bottom plan view of the device of FIG. 3.

Turning now to FIGS. 3 to 15 there is shown a lampholder 60 constructed in accordance with the concepts of the invention. A body 62 formed of an insulating material such as porcelain, plastic, rubber or the like is formed with a smooth continuous neck 64 having a central bore 66 therethrough. A recess or cavity 68 is formed in the rear of the body 62 and communicates with central bore 66. An annular ring 70 is placed adjacent the juncture of the recess 68 and bore 66. Slots 72 (only one of which is visible in FIG. 4) in the rear face of annular ring 70 are employed to position the switch assembly and prevent rotation thereof during installation or removal of a lamp into the threaded screwshell as will be described. Recessed pads 74, 76 each contain two keyhole slots 78, 84, respectively, on different centers. Keyhole slots 78 are arranged to accept mounting screws (not shown) of 3¼" outlet boxes, for example, and keyhole slots 84 are arranged to accept mounting screws (not shown) of 4" outlet boxes. The mounting screws are placed in the threaded apertures in the outlet box ears (not shown) with the screw heads below the outlet box surface. The screws are permitted to enter the proper set of keyhole slots by entering the large end apertures 80, 86. The body 62 is then twisted so that the screws enter the elongate slots 82, 88, respectively. The screws can then be tightened to complete the assembly of the lampholder 60 to the outlet box. A depression 90 (see FIG. 5) in recess 68 further contains an aperture 92 through which the pull or bead chain 94 of the switch assembly 150 passes. Two support pads 96, 98 for the ends of terminal members 100 and 102 are provided about the central bore 66. Support pad 96 has two upstanding walls 104 which prevent the terminal member 100 from rotating and support pad 98 similarly has two upstanding walls 106 to prevent terminal member 102 from rotating as a lamp is made to threadably engage or disengage the threaded screwshell 67. A collar 108 is built up on the surface of lampholder body 62 about aperture 92 with a rounded entrance 110 to permit the bead chain 94 to move easily within the aperture 92 (see FIGS. 3 and 12).

Figure 7:
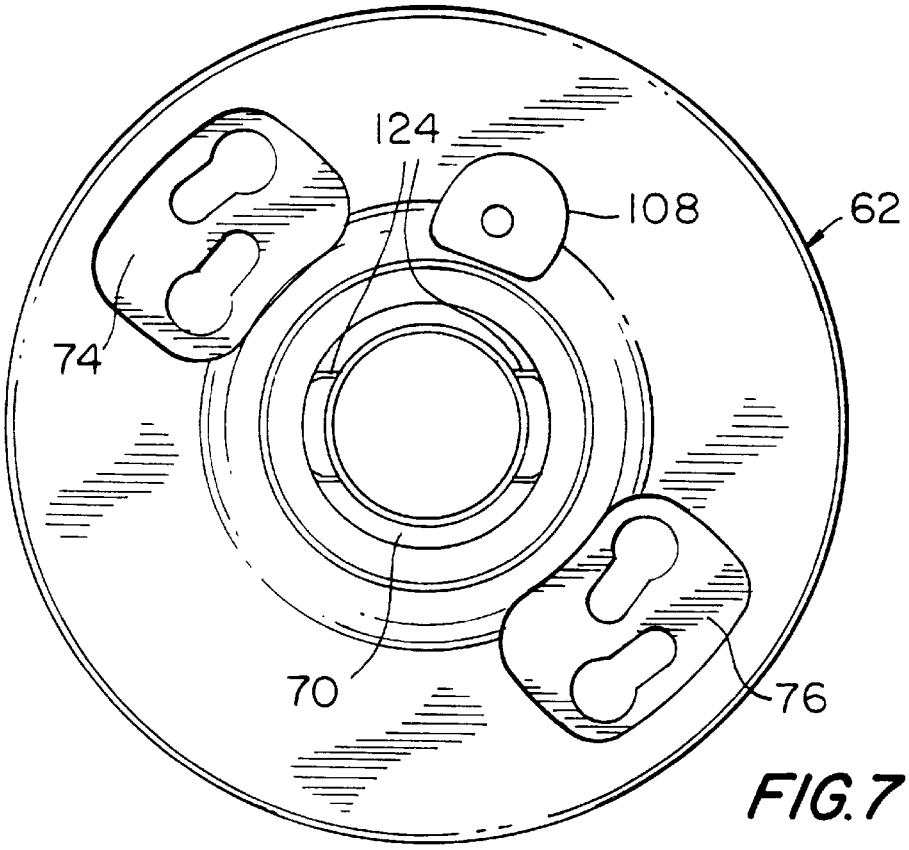
FIG. 7 is a bottom plan view of the body member of the lampholder of FIG. 3.
Figure 8:
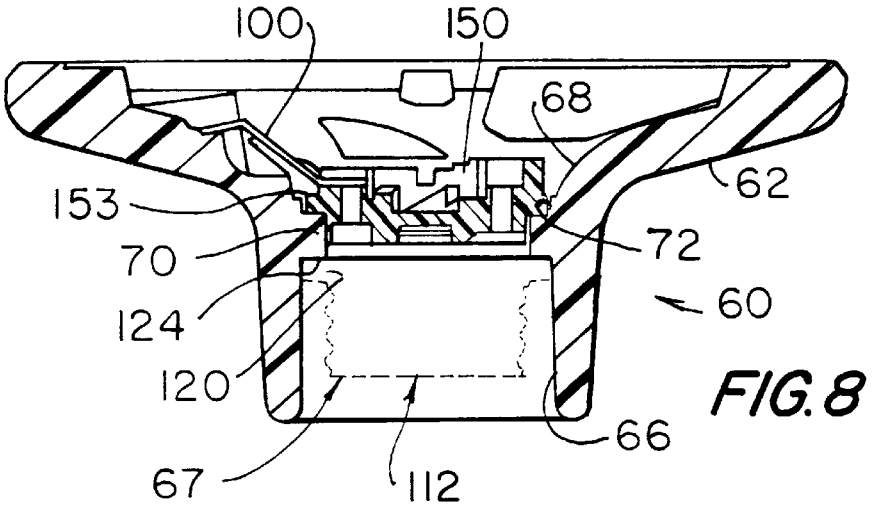
FIG. 8 is a side elevational view, partially in section, of the body member of FIG. 3 taken along 8—8 in FIG. 6.
Figure 10:
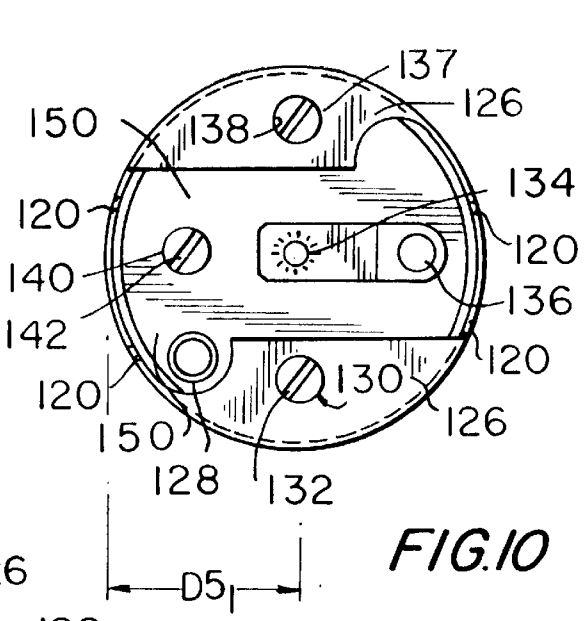
FIG. 10 is a front elevational view the threaded screwshell of FIG. 9 with the spring biased contact installed.
Figure 11:
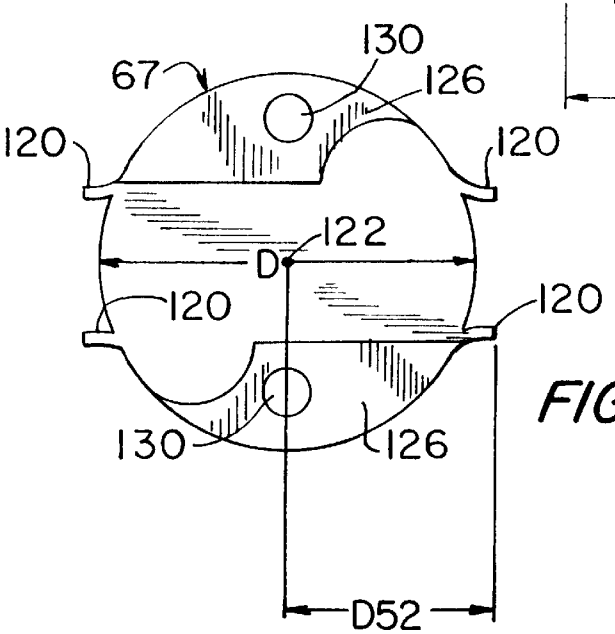
FIG. 11 is a front elevational view of the threaded screwshell of FIG. 9 with the stop tabs deployed.
Figure 9:
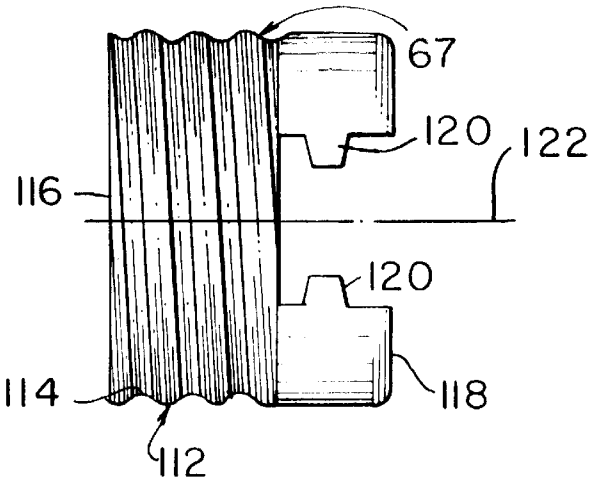
FIG. 9 is a side elevational view of the threaded screwshell of the device of FIG. 3.

The threaded screwshell 67 (see FIGS. 9, 10 and 11) is made up of a tube 112 of conductive metal with threads 114 formed from a first end 116 to approximately the middle of the tube 112 for the threaded engagement with the screw threaded base of a lamp (not shown). Adjacent the second end 118 of the tube 112, a portion of the perimeter of tube 112 is removed to form two tabs 120 adjacent each end of a tube diameter D extending perpendicularly to the central longitudinal axis 122 of the threaded screwshell 67. The two tabs 120 on each side of tube 112 are displaced outwardly and generally parallel with diameter D. The dimension $D_{52}$ is greater than the dimension $D_{51}$ which is the distance between longitudinal axis 122 and the outer periphery of tube 112 adjacent end 118. As shown in FIG. 7, the front face of annular ring 70 has two recesses 124 on opposite sides of a diameter each of which receives the two extended tabs 120 on one end of the diameter to prevent the threaded screwshell 67 being pulled through central bore 66 and out of recess 68. As will be described below, the tabs 120 are employed to clamp the switch assembly 150 and threaded screwshell 67 together with the annular ring 70 between them.

Returning to FIGS. 9 to 11, the ends 126 of the tube 112 at end 116 are folded inwardly perpendicular to the axis 122. The ends 126 are in turn fixed to the switch assembly 150 casing and skirt 154 by means of rivets or eyelets 128 or screws 132 passed through apertures 130. The casing of switch assembly 150 and skirt 154 are made of phenolic or other insulating materials. A flat spring contact 134 is anchored to switch assembly 150 by a rivet or eyelet 136 and is insulated from ends 126 by switch assembly 150. A bolt 142 passing through aperture 140 is connected to spring contact 134 to connect one of the lines of the AC power source to the base contact of a lamp threadably engaging the threaded screwshell 67. A further screw 138 passing through aperture 137 engages an end 126 so that the threaded screw base of an inserted lamp is electrically connected to the threaded screwshell 67 and to the other line of the AC power source.

Figure 6:
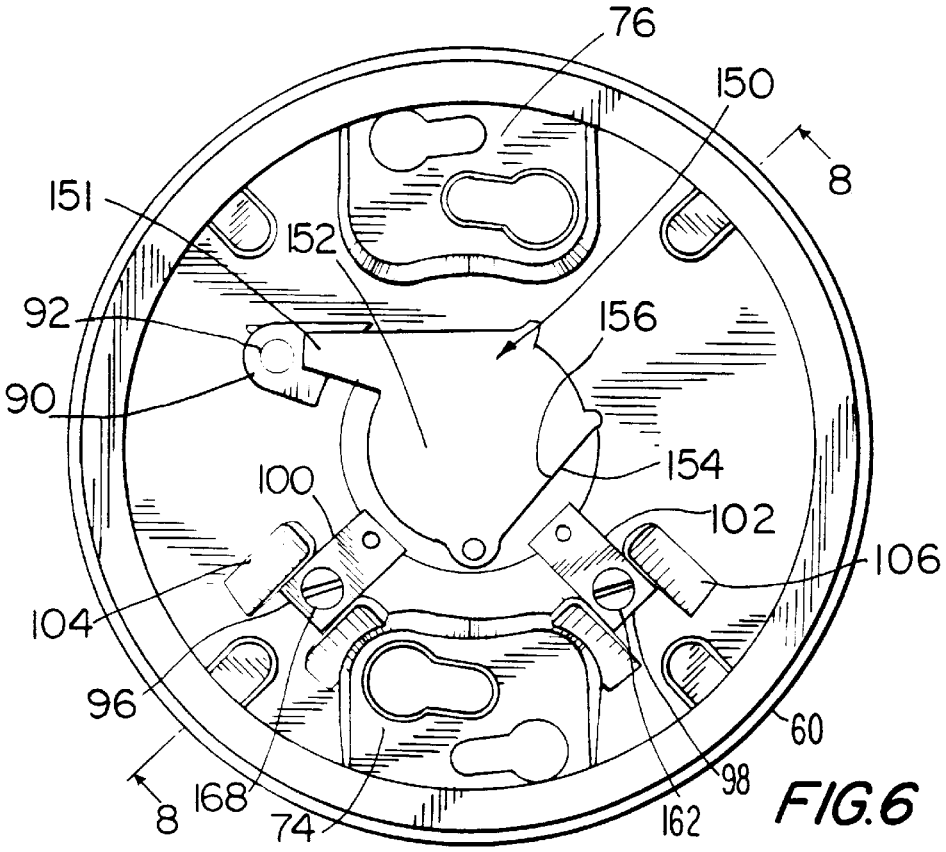
FIG. 6 is a top plan view of the body member as shown in FIG. 5 with the switch assembly added.

The switch assembly 150 will now be described with reference to FIGS. 4, 5, 6, 13 and 14. The switch assembly 150 includes a sealed portion 152 containing a rotary switch operated between on and off positions by a pull chain or bead chain 94. The portion 152 has a skirt portion 154 about the central portion 156 of portion 152 as best seen in FIG. 6. An aperture (not visible) permits bolt 138 to engage a metal contact plate 158 and enter a threaded aperture in the end of terminal member 102 (see FIG. 14). The end of terminal member 102 rests on support pad 98 between upstanding walls 106 which prevents rotation of the terminal member 102 and the switch assembly 150. A terminal screw 162 threadably engaging threaded aperture 164 permits the bared end of a conductor, connected to one of the lines of the AC power source, to be joined to terminal member 102 which is thus connected by bolt 138 to the threaded screwshell 67. Bolt 142 extends through aperture 140 and an aperture (not visible) in skirt 154 to engage a metal contact plate similar to plate 158 but not visible and threadably engage the aperture in the end portion of terminal member 100. The end 166 of terminal member 100 rests upon support pad 96 between upstanding walls 104 which prevents rotation of the terminal member 100 and the switch assembly 150. Terminal screw 168 threadably engages threaded aperture 170 and can be tightened upon the bared end of the second conductor connected to the other line of the AC power source.

To assemble the lampholder 60, a switch assembly 150 is placed in the recess or cavity 68 so that neck 151 is within depression 90 and pull or bead chain 94 extends through aperture 92 and through collar 108. Tabs 153 (see FIG. 8) are placed in recesses 72 in the rear face of annular ring 70. This positions the switch assembly 150 and prevents its rotation when a lamp is made to threadably engage or disengage threaded screwshell 67. It also prevents downward movement of switch assembly 150 through central bore 66. Terminal member 100 is placed with end 166 on support pad 96 and its other end on contact plate 158 while terminal member 102 is placed with end 160 on support pad 98 and its other end on a contact plate similar to contact plate 158.

The threaded screwshell 67 is introduced with end 118 first into central bore 66 and advanced until the outwardly deflected tabs 120 are positioned in the recesses 124 on the front face of annular ring 70. Now a bolt 142 is passed through aperture 140 through an aperture in skirt 154, a threaded aperture in the contact plate and a threaded aperture in the end portion of terminal member 100. A bolt 138 is similarly passed through an aperture in skirt 154, a threaded aperture in contact plate 158 and a threaded aperture in the end portion of terminal member 102. A bolt 132 passing through aperture 130 into switch assembly 150 provides additional assembly support.

The switch assembly 150 and the threaded screwshell 67 are now joined to each other and clamped to the rear and front faces, respectively, of annular ring 70. (See FIG. 15).

Figure 16:
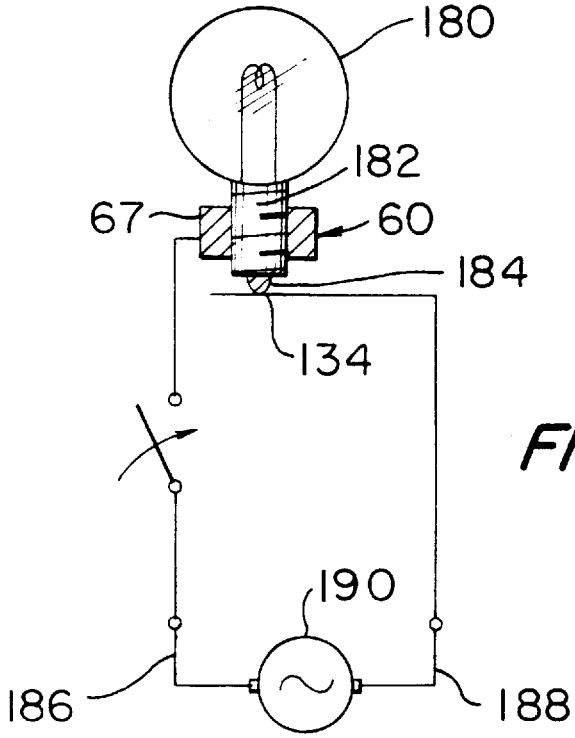
FIG. 16 is a schematic showing the wiring of the instant lampholder to a source of AC power.

FIG. 16 shows schematically how the pull chain lampholder 60 can be wired to a source of AC power 190. AC power source 190 is connected by lead 188 directly to the contact spring 134 which contacts the base contact 184 of lamp 180 whose threaded screwshell 182 is made to threadably engage threaded screwshell 67. When pull chain 94 is pulled to close the switch, lead 186 is completed to the threaded screwshell 67 and lamp 180 is caused to light.

While there has been shown and described and pointed out the fundamental novel features of the invention as applied to the preferred embodiment as presently contemplated, it will be understood that various omissions and substitutions and changes of the form and details of the devices illustrated and in its operation may be made by those skilled in the art, without departing from the spirit of the invention.

We claim:

1. A pull chain outlet box lampholder comprising:

a) a body member having a rear face and a front face with a neck extending from said front face along a longitudinal axis perpendicular to the plane of said body member;

b) a recess in said rear face;

c) a uniform diameter central bore in said neck extending from the free end of said neck to said recess in said rear face;

d) an annular ring about the wall of said neck defining said central bore extending partly into said central bore at the junction of said central bore and said recess;

e) switch assembly means in said recess positioned adjacent a rear face of said annular ring;

f) threaded screwshell means positioned in said bore of said neck and adjacent a front face of said annular ring; and g) fastening means engaging said switch assembly means and said threaded screwshell means to hold said switch assembly means and said threaded screwshell means in assembly to each other and to said annular ring.

2. A lampholder as defined in claim 1 wherein said body member has an aperture from said rear face to said front face to permit a pull chain of said switch assembly means to extend through said body member and a collar on said front face adjacent said aperture, said collar having a further aperture communicating with said aperture and the end of said further aperture adjacent the free end of said collar rounded to permit said pull chain to move freely within said aperture and said further aperture.

3. A lampholder as defined in claim 1, wherein said rear face of said annular ring has first recesses therein and said switch assembly means has first tabs which enter associated first recesses when said switch assembly means is properly positioned in said recess of said body member.

4. A lampholder as defined in claim 1, wherein said front face of said annular ring has first recesses therein and said threaded screwshell means has first tabs which enter associated first recesses when said threaded screwshell means is properly positioned in said central bore of said neck.

5. A lampholder as defined in claim 1, wherein:

a) said rear face of said annular ring has first recesses therein;

b) said switch assembly means has first tabs which enter associated first recesses when said switch assembly means is properly positioned in said recess of said body member;

c) said front face of said annular ring has second recesses therein; and d) said threaded screwshell means has second tabs which enter associated second recesses when said threaded screwshell means is properly positioned in said central bore of said neck.

6. A lampholder as defined in claim 4, wherein said first tabs are deflectable portions of said threaded screwshell means.

7. A lampholder as defined in claim 5, wherein said second tabs are deflectable portions of said threaded screwshell means.

8. A lampholder as defined in claim 1, further comprising:

a) mounting holes extending through said body member from a rear face to a front face, said mounting holes located a fixed distance from said longitudinal axis;

b) said mounting holes permitting the passage of fastening means therethrough to secure said body member to an outlet box; and c) said mounting holes are keyhole slots which permit said lampholder to be mounted to an outlet box by twisting the lampholder after it has been positioned upon said outlet box.

9. A lampholder as defined in claim 8, further comprising:

a) additional mounting holes extending through said body member from a rear face to a front face, said additional mounting holes located at a distance from said longitudinal axis different than said fixed distance;

b) said additional mounting holes permitting the passage of fastening means therethrough to secure said body member to an outlet box;

c) said mounting holes and said additional mounting holes permitting said body member to be mounted to outlet boxes of different dimensions; and d) said additional mounting holes are each keyhole slots which permit said lampholder to be mounted to an outlet box by twisting the lampholder after it has been positioned upon said outlet box.

10. A method of assembling a lampholder comprising the steps of:

a) positioning an insulated body having a rear face with a recess therein and a neck perpendicular to the front face of such insulating body, a uniform diameter central bore in said neck communicating with said recess and having an annular ring in said bore adjacent its juncture with said recess and partly extending into said bore so that said recess and said bore are accessible;

b) inserting a switch assembly means in said recess and against the rear face of said annular ring;

c) inserting a threaded screwshell means in said bore and against the front face of said annular ring; and d) inserting fasteners through apertures in said threaded screwshell means into threaded apertures in said switch assembly means to fasten said switch assembly means to said threaded screwshell means and clamp said annular ring between them whereby said insulated body, said switch assembly means and said threaded screwshell means are assembled.

* * * * *